US010749306B2

(12) United States Patent
Wang

(10) Patent No.: US 10,749,306 B2
(45) Date of Patent: Aug. 18, 2020

(54) COAXIAL CABLE CONNECTOR COMPRESSION TOOL

(71) Applicant: EZCONN CORPORATION, New Taipei (TW)

(72) Inventor: Cheng-Hui Wang, Taipei (TW)

(73) Assignee: EZconn Corporation, Taipei (TW)

( * ) Notice: Subject to any disclaimer, the term of this patent is extended or adjusted under 35 U.S.C. 154(b) by 265 days.

(21) Appl. No.: 15/644,848

(22) Filed: Jul. 10, 2017

(65) Prior Publication Data

US 2018/0013253 A1 Jan. 11, 2018

(30) Foreign Application Priority Data

Jul. 11, 2016 (TW) ..... 105210312 U

(51) Int. Cl.

| | |
|---|---|
| ***H01R 43/042*** | (2006.01) |
| ***H01R 9/05*** | (2006.01) |
| ***H01R 43/01*** | (2006.01) |
| ***B25B 27/02*** | (2006.01) |

(52) U.S. Cl.

CPC ..... *H01R 43/042* (2013.01); *H01R 9/0518* (2013.01); *H01R 43/015* (2013.01); *H01R 43/0425* (2013.01); *B25B 27/02* (2013.01)

(58) Field of Classification Search

CPC .... B25B 27/02; H01R 43/015; H01R 43/042; H01R 43/0425; H01R 9/0518

See application file for complete search history.

(56) References Cited

U.S. PATENT DOCUMENTS

| | | | | |
|---|---|---|---|---|
| 5,934,137 | A * | 8/1999 | Tarpill | H01R 43/042 29/282 |
| 6,293,004 | B1 * | 9/2001 | Holliday | B25B 27/10 29/751 |
| 6,591,487 | B2 * | 7/2003 | Chang | B25B 27/10 29/751 |
| 6,708,396 | B2 * | 3/2004 | Holliday | B25B 27/10 29/33 M |
| 7,120,997 | B2 * | 10/2006 | Islam | B25B 27/10 29/751 |
| 7,627,944 | B2 * | 12/2009 | Holliday | B25B 27/10 29/751 |
| 2006/0042346 | A1 * | 3/2006 | Holliday | B21D 39/048 72/409.14 |
| 2018/0013253 | A1 * | 1/2018 | Wang | H01R 9/0518 |

* cited by examiner

*Primary Examiner* — Minh N Trinh

(57) ABSTRACT

A tool for mounting a coaxial cable on a first connector is disclosed, wherein the coaxial cable extending along a first axial is adapted to pass through a first outer sleeve of the first connector, wherein the tool comprises a plunger; and a mold comprising an upper mold hinge and a lower mold hinge, wherein the upper mold hinge pivotally connected to the lower mold hinge so as to rotate the upper mold hinge relative to the lower mold hinge with respect to a rotation axis, and a second axial direction of the rotation axis is parallel to the first axial direction, wherein the plunger is adapted to push the first connector so as to force the upper mold hinge and the lower mold hinge to press the first outer sleeve so as to deform the first outer sleeve radially.

13 Claims, 17 Drawing Sheets

COAXIAL CABLE CONNECTOR COMPRESSION TOOL

RELATED APPLICATION

This patent application claims priority of Taiwan Patent Application No. 105210312, filed on Jul. 11, 2016, the entirety of which is incorporated herein by reference.

BACKGROUND OF THE DISCLOSURE

Field of the Disclosure

The present invention relates to a tool, and more particularly to a tool for mounting a coaxial cable to a connector.

Brief Description of the Related Art

When using a conventional crimping tool to crimp different types of connector (e.g. F-type coaxial terminals, BNC-type coaxial terminals) or connectors of a same type but with different specifications (e.g. different lengths), various crimping tools are needed, which cause some difficulties when operating the crimping tools. Furthermore, the size of the conventional crimping tool is too large for handling and carrying.

Accordingly, it is desired to provide a coaxial cable crimping tool that has the characteristics of versatility, small size and low cost to resolve the above-mentioned issues.

SUMMARY OF THE DISCLOSURE

In one embodiment of the present invention, a tool for mounting a coaxial cable on a first connector is provided, the coaxial cable is suitable to pass through a first outer sleeve of the first connector along a first axial direction, said tool comprising a plunger and a mold comprising an upper mold hinge and a lower mold hinge, wherein the upper mold hinge is pivotally connected to the lower mold hinge so as to rotate the upper mold hinge relative to the lower mold portion with respect to a rotation axis, wherein a second axial direction of the rotation axis is parallel to the first axial direction, wherein the plunger is adapted to push the first connector so as to allow the upper mold hinge and the lower mold hinge to press the first outer sleeve to deform the first outer sleeve radially.

In one embodiment of the present invention, a tool for mounting a coaxial cable on a first connector is provided, the coaxial cable being suitable to pass through a first outer sleeve of the first connector along an axial direction, said tool comprising a base and a mold on the base, the mold being adapted to move relative to the base along the axial direction to press the first outer sleeve to deform the first outer sleeve.

In one embodiment of the present invention, a tool for mounting a coaxial cable on a first connector is provided, the coaxial cable being suitable to pass through a first outer sleeve of the first connector along an axial direction, said tool comprising a base and a mold on the base, the mold being located at an end of a moving path, wherein the mold is adapted to move toward the mold base along the axial direction so as to press the outer sleeve to deform the outer sleeve.

In one embodiment of the present invention, a tool for mounting a coaxial cable to a first connector or a second connector is provided, the coaxial cable being suitable to pass through a first outer sleeve of the first connector, wherein the format of the first connector is different from that of the second connector, said tool comprising: a base; a mold on the base; a first pressing element module, suitable to be disposed on the base and adapted to move relative to the base in a direction towards the mold so as to press the first outer sleeve to deform the first outer sleeve; and a second pressing element module, suitable to be disposed on the base and adapted to move relative to the base in a direction towards the mold so as to press the second outer sleeve to deform the second outer sleeve, wherein the format of the first pressing element module is different from that of the second pressing element module for matching with different formats of the first connector and the second connector, respectively.

In one embodiment of the present invention, a tool is provided for mounting a coaxial cable to a connector, the coaxial cable being suitable to pass through a first outer sleeve of the connector, said tool comprising a base and a mold disposed on a rod of the base, the mold being adapted to move relative to the rod along an extension direction of the rod to press the outer sleeve so as to deform the outer sleeve.

DETAILED DESCRIPTION OF THE INVENTION

Figure 1B:
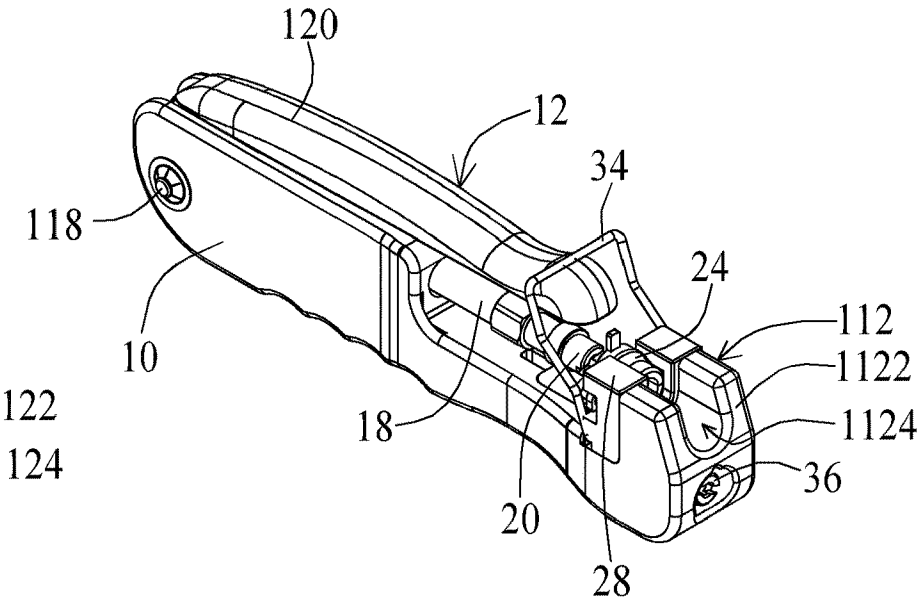
FIG. 1*b* is a schematic 3D view of the tool according to a second implementation of the first embodiment of the present invention.
Figure 1A:
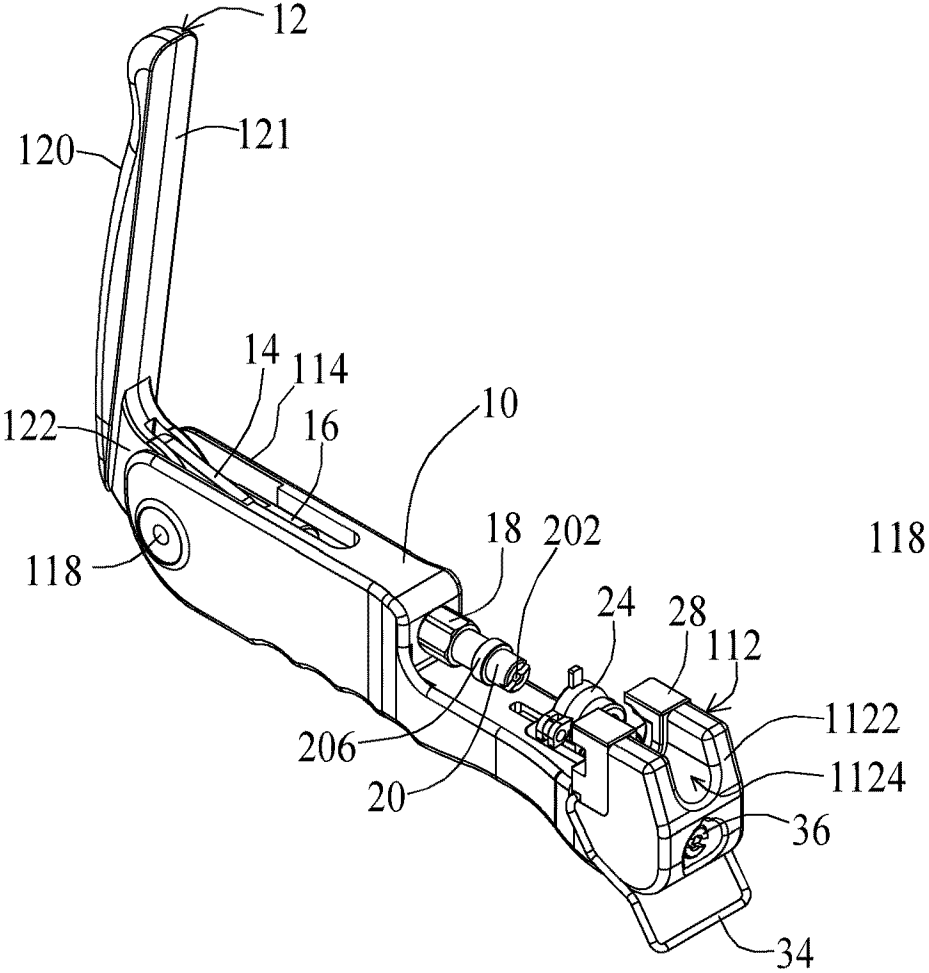
FIG. 1*a* is a schematic 3D view of a tool according to a first implementation of a first embodiment of the present invention.
Figure 2:
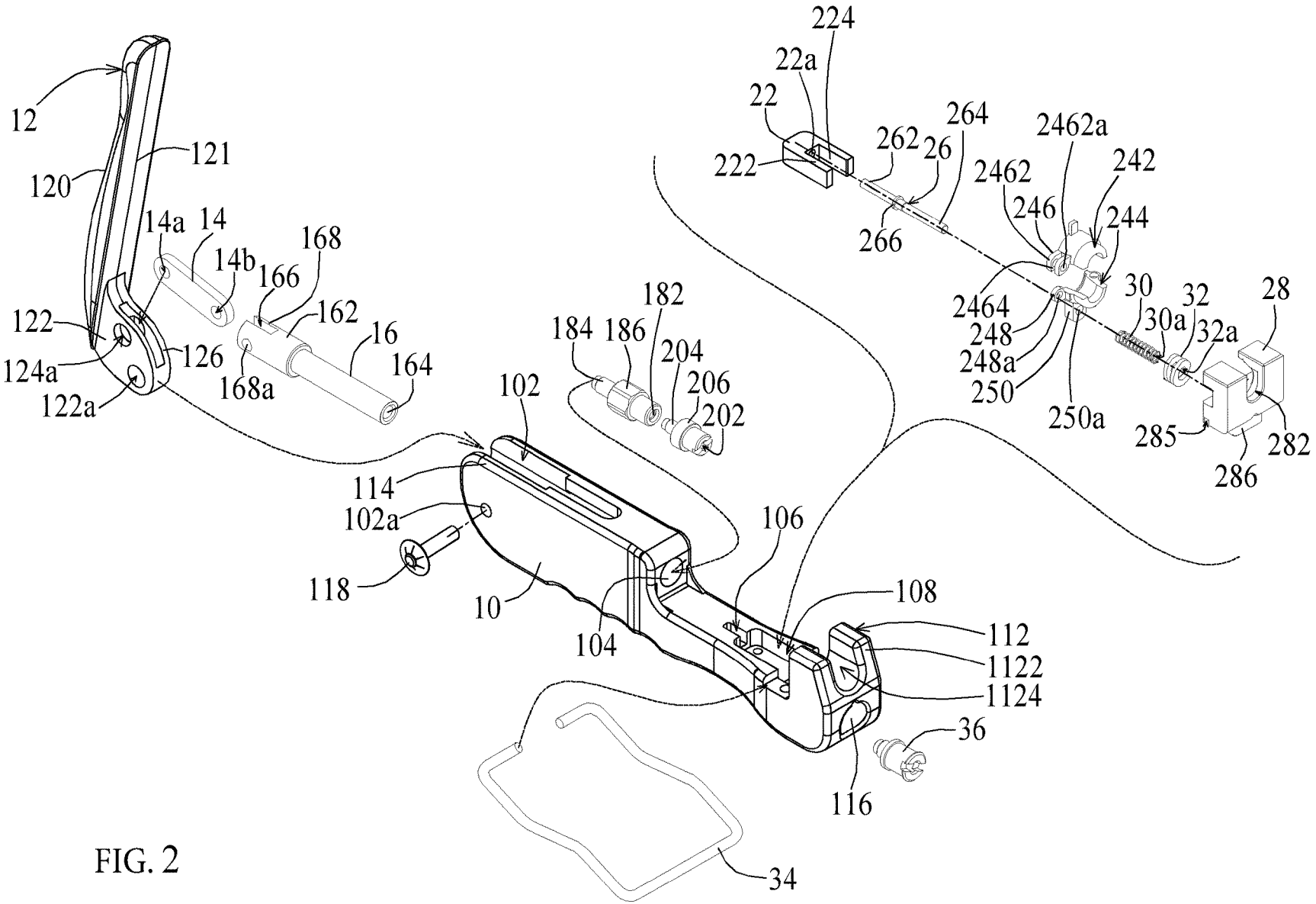
FIG. 2 is an exploded 3D view of the tool according to the first embodiment of the present invention.
Figure 3:
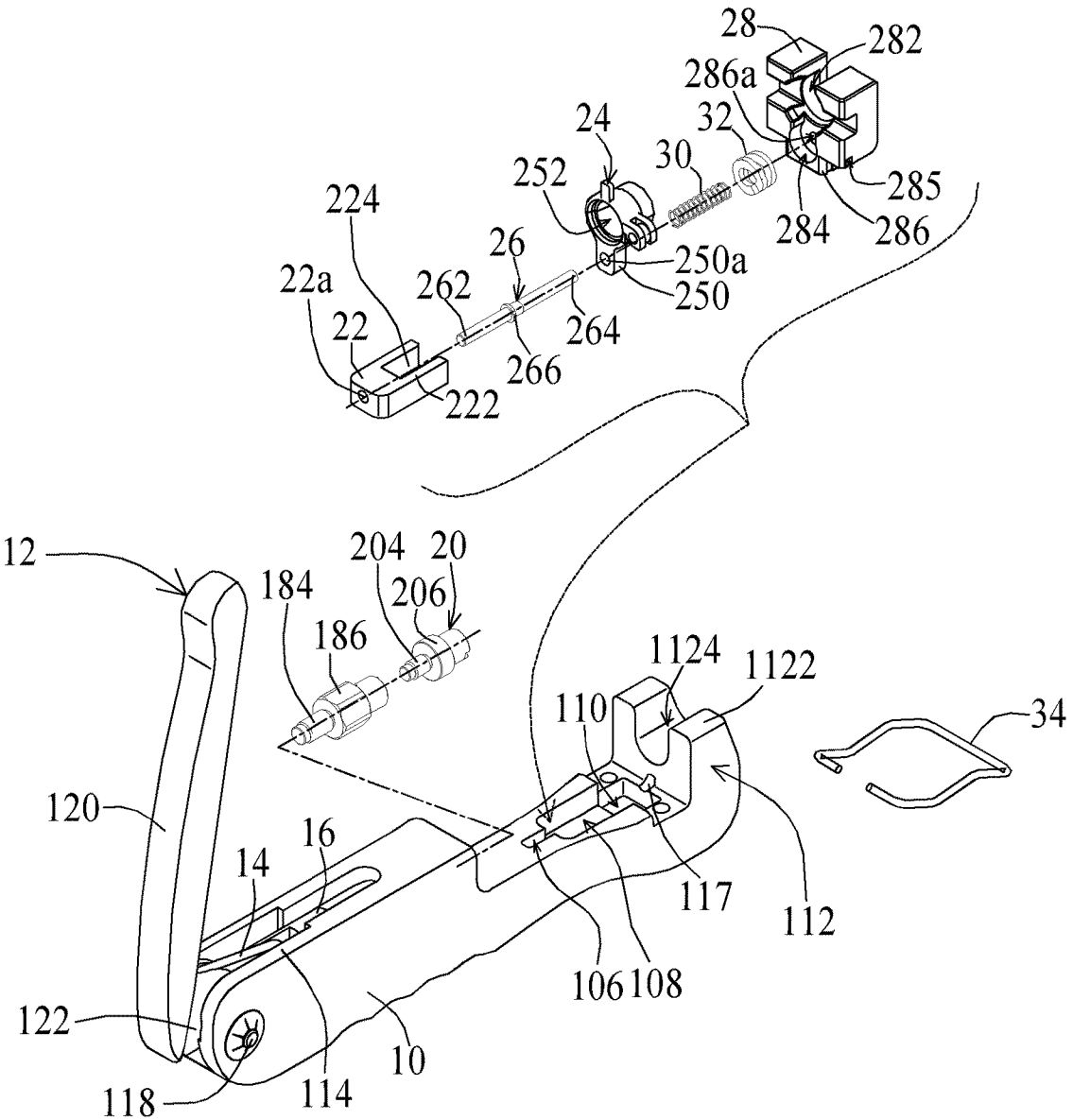
FIG. 3 is a schematic exploded view of another aspect of the tool of the first embodiment of the present invention.
Figure 4:
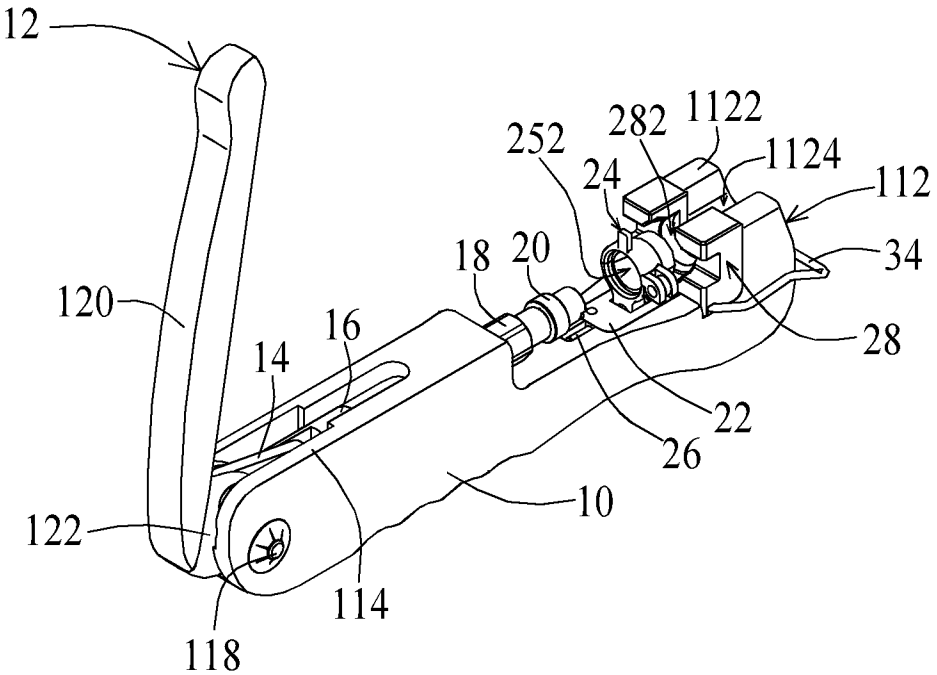
FIG. 4 is a schematic 3D view of another aspect of the tool of the first embodiment of the present invention.
Figure 5:
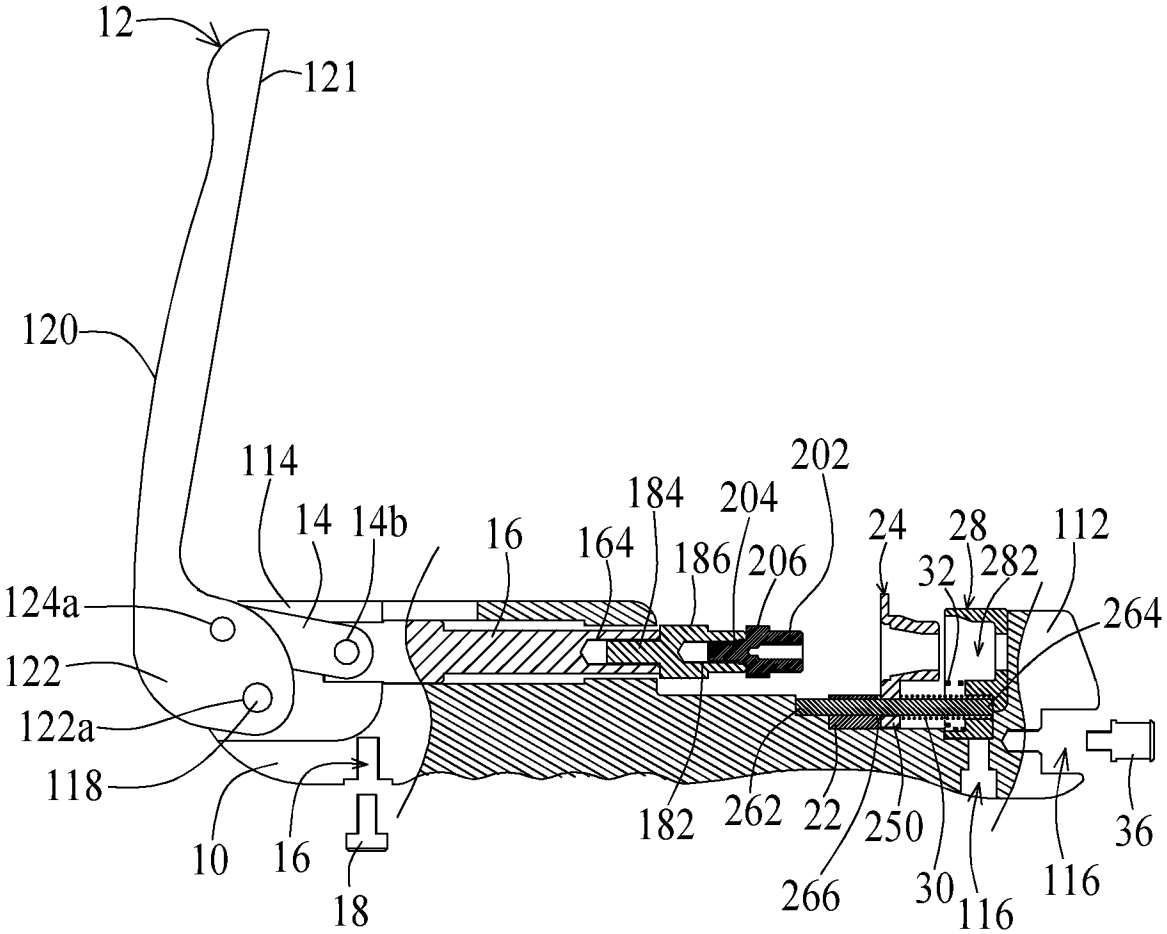
FIG. 5 is a schematic cross-sectional view of the tool of the first embodiment of the present invention.
Figure 6A:
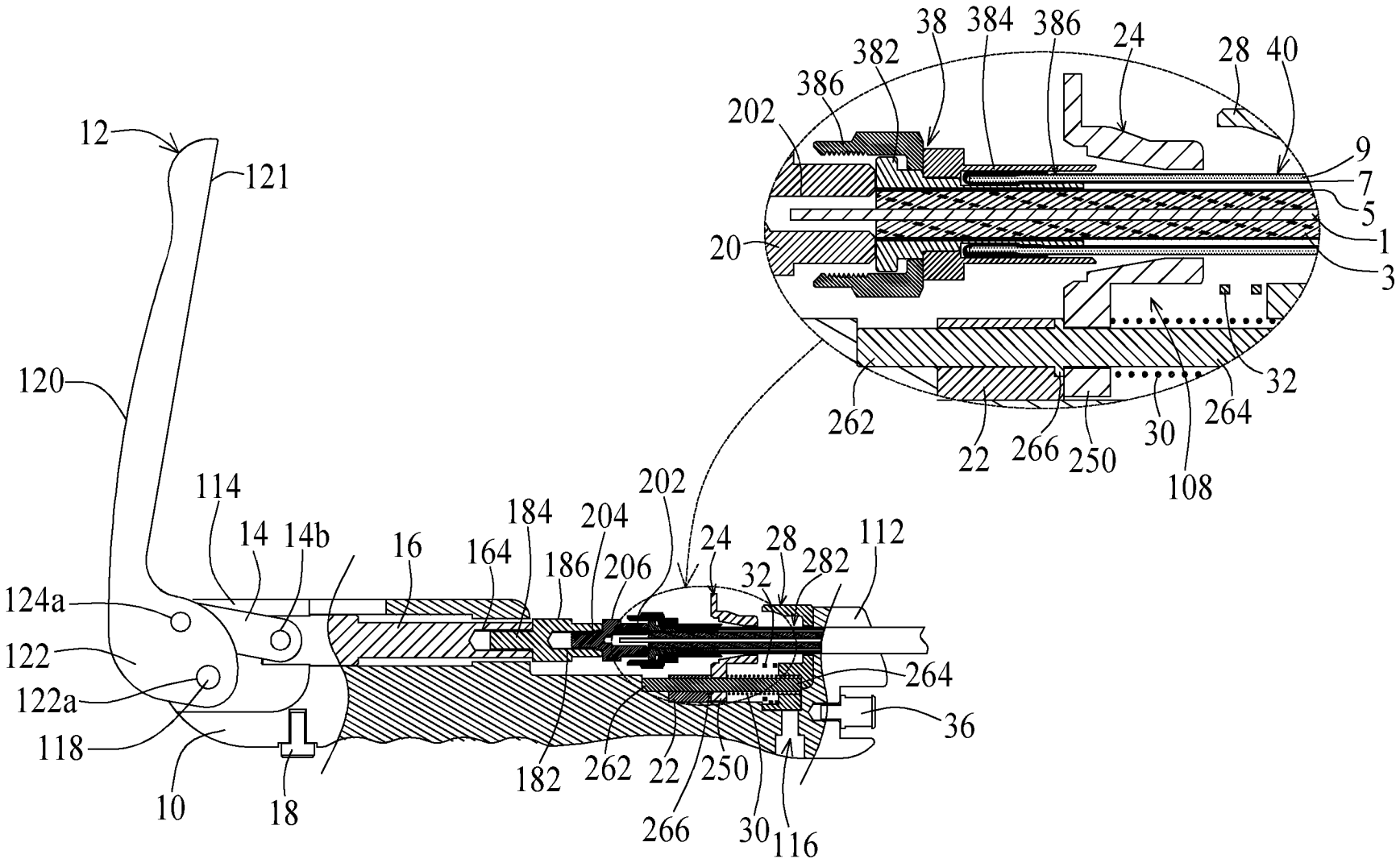
FIG. 6*a* is a schematic cross-sectional view showing the tool of the first embodiment before a coaxial cable connector is operated.
Figure 6B:
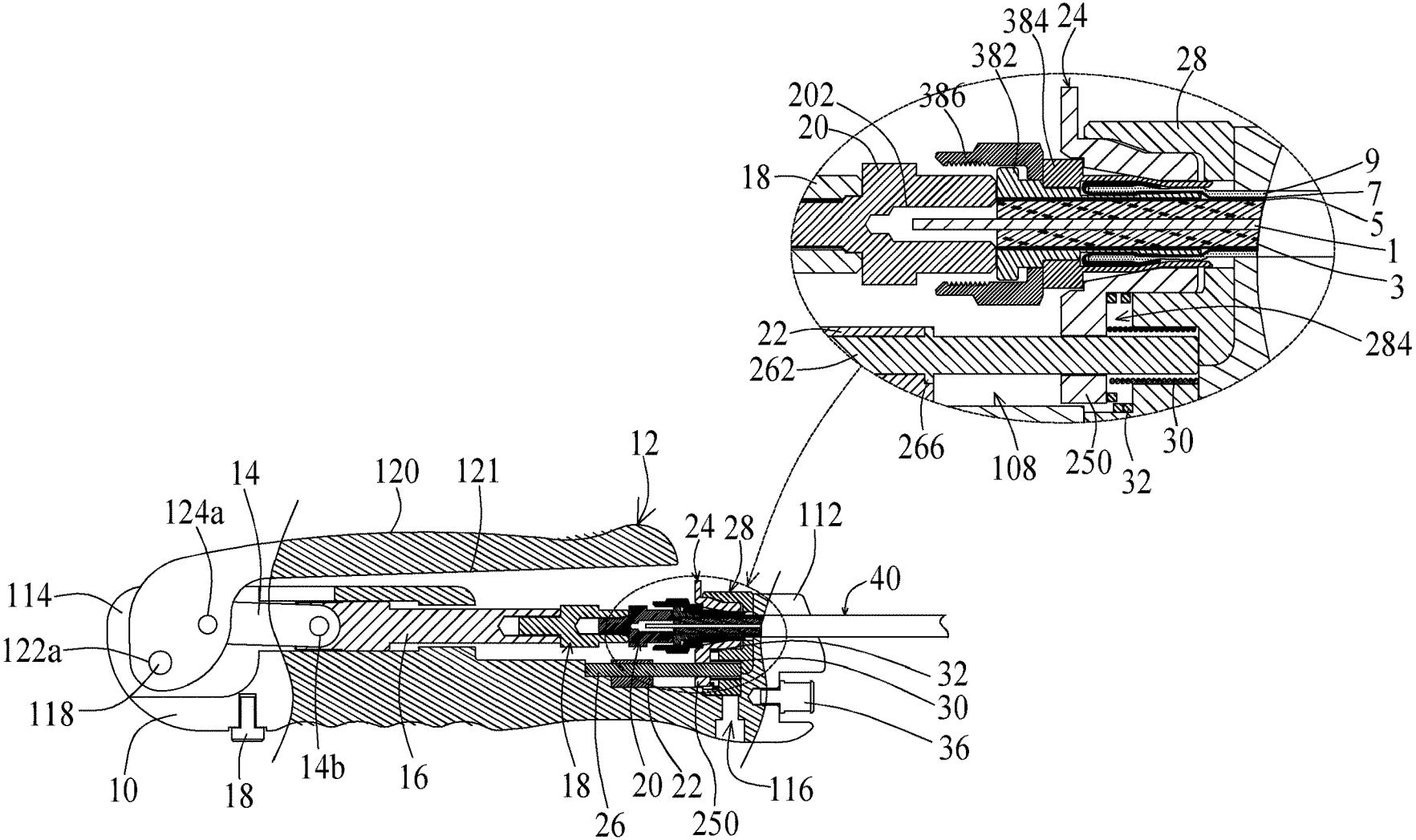
FIG. 6*b* is a schematic cross-sectional view showing the tool of the first embodiment after the coaxial cable connector is operated.
Figure 7B:
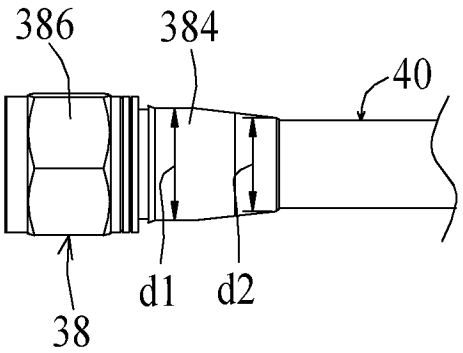
FIGS. 7*a* and 7*b* are schematic views showing a comparison between operations illustrated in FIG. 6*a* and FIG. 6*b;*
Figure 7A:
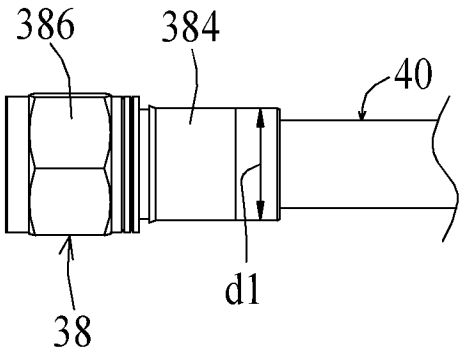
Figure 8B:
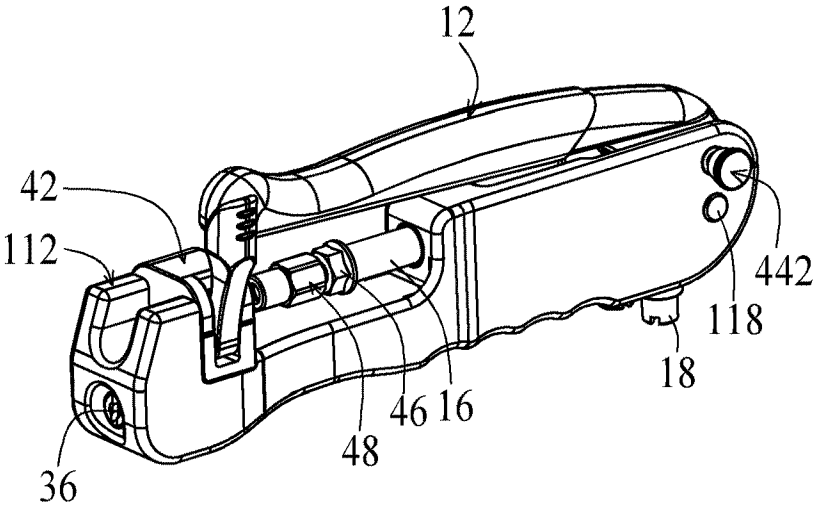
FIG. 8*b* is a schematic 3D view of a tool according to a second implementation of the second embodiment of the present invention.
Figure 8A:
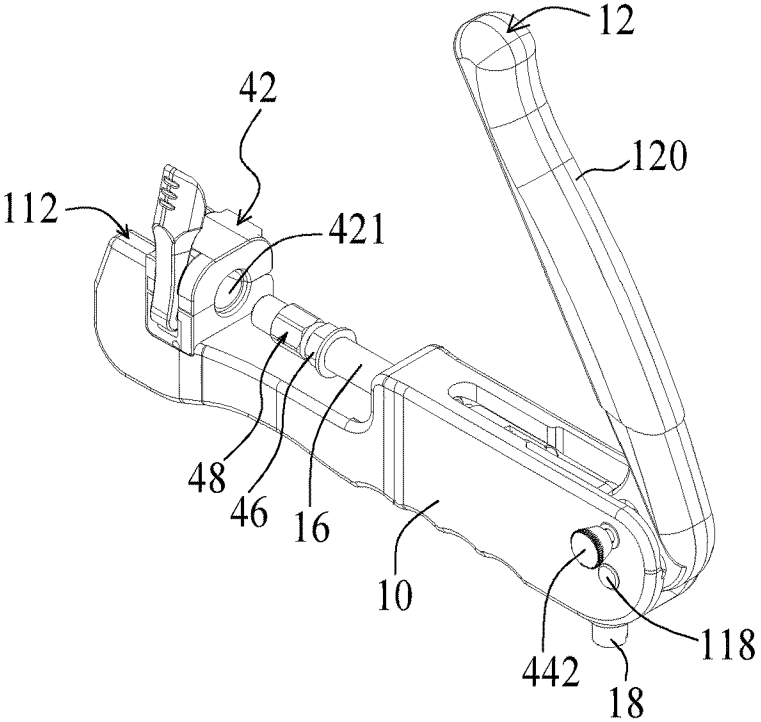
FIG. 8*a* is a schematic 3D view of a tool according to a first implementation of a second embodiment of the present invention.
Figure 8C:
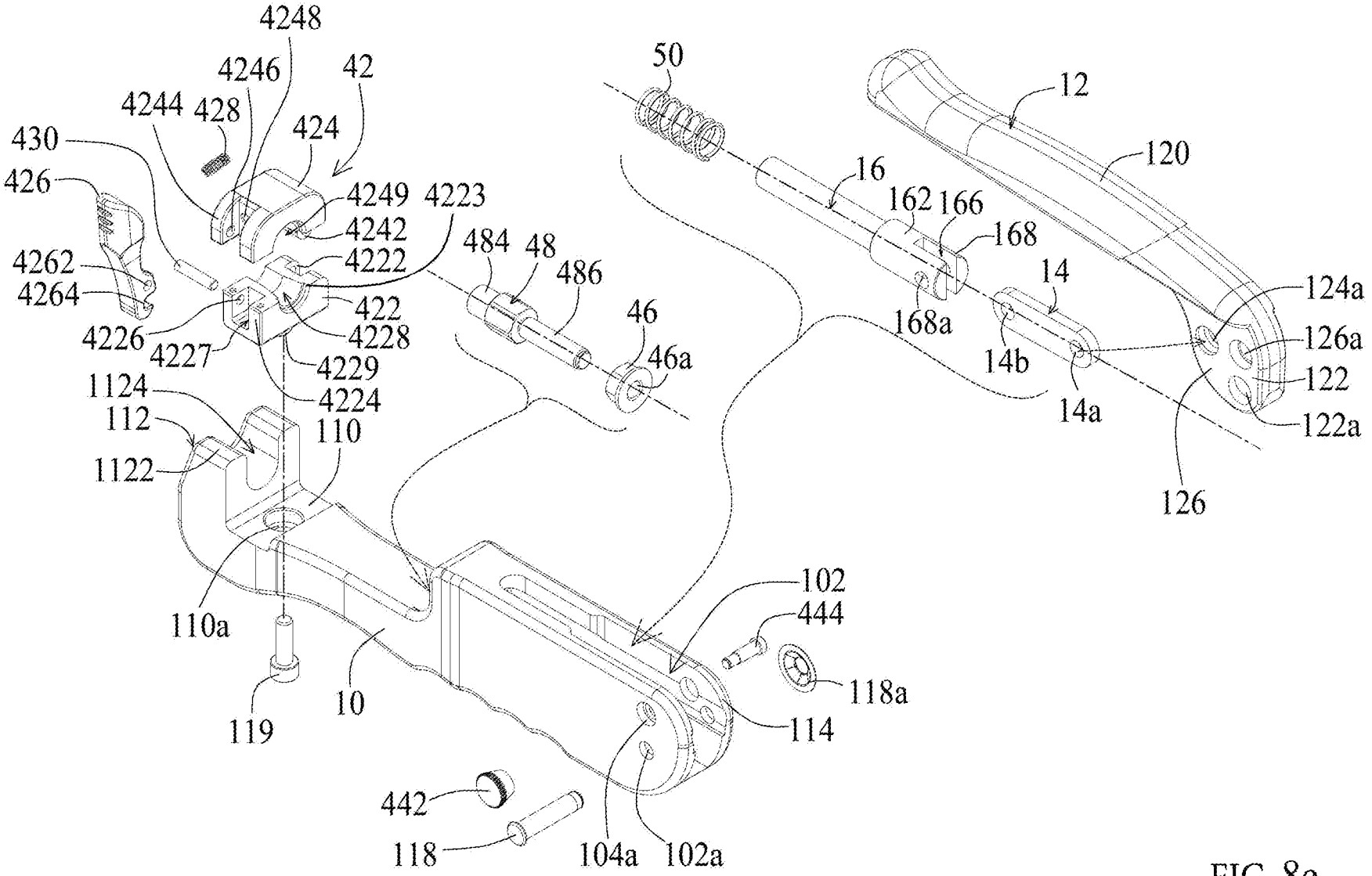
FIG. 8*c* is a schematic exploded view of the tool of the second embodiment of the present invention.
Figure 8D:
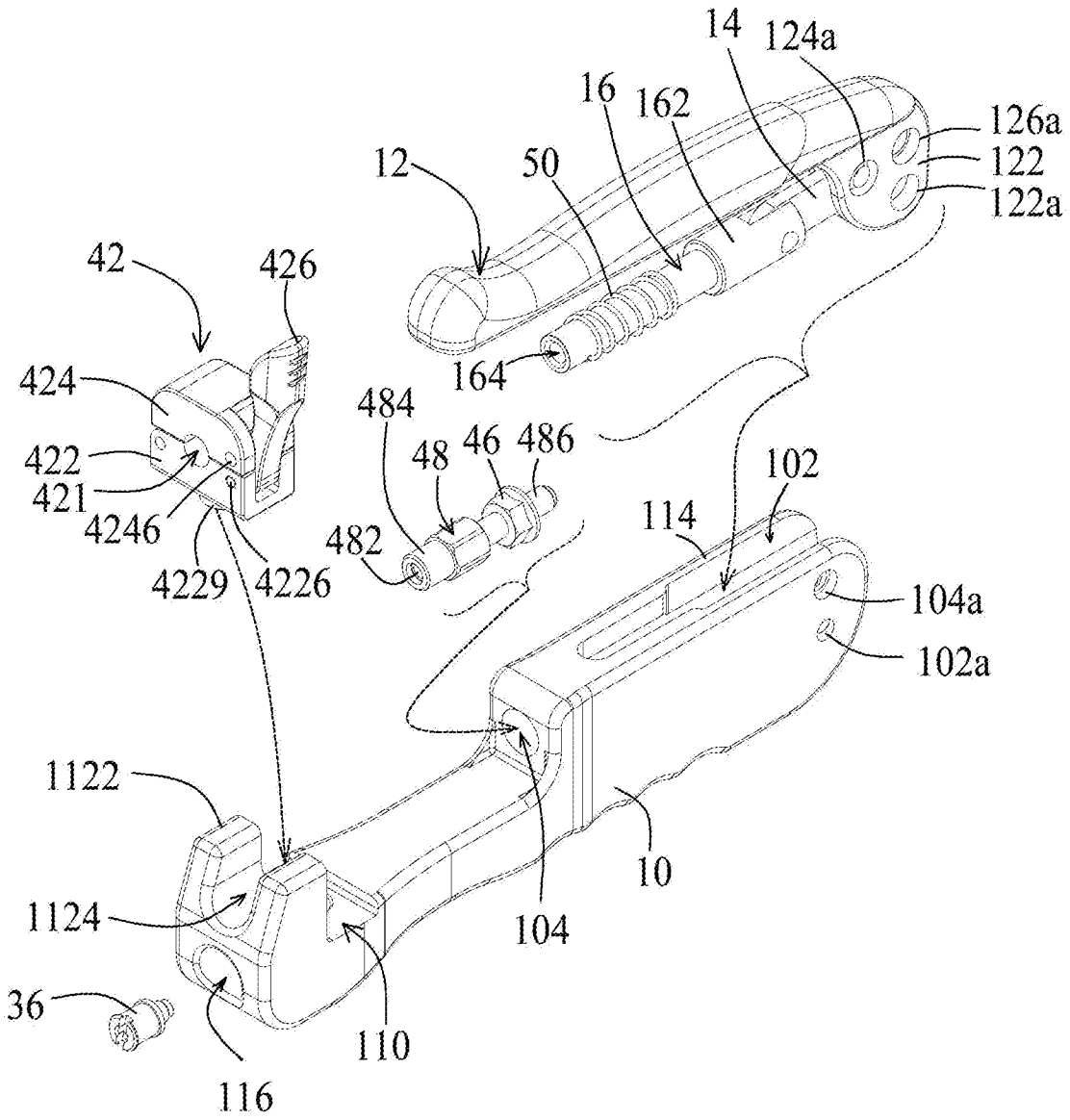
FIG. 8*d* is a schematic exploded view of the tool of the second embodiment of the present invention.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

The tool of the present invention further uses a mold base to abut and press the mold so as to deform the outer sleeve by way of disposing the outer sleeve of the coaxial cable connector in the mold, wherein the deformed outer sleeve in turn presses the plastic jacket of the coaxial cable to fixedly engage the outer sleeve with the coaxial cable.

First Embodiment

As shown in FIGS. 1*a*, 1*b*, and 2 to 5, the coaxial cable tool includes a base 10, a lever arm 12, a floating link 14, a plunger 16, a replaceable element 18, a chuck 20, a connecting block 22, a mold 24, a rod 26, a mold base 28, a spring 30, a spring 32, a fixing ring 34 and a chuck 36.

The base 10 includes a recess 102, a perforation 104, a recess 106, a recess 108, a recess 110 and an blocking portion 112, wherein the recess 102 interconnects with the perforation 104, the recess 106 interconnects with the recess 108, the two side walls 114 of the recess 102 have a perforation 102*a*, respectively, and the base 10 also has three receptacles 116 disposed on the bottom surface and the side surface respectively. Additionally, there are a recess groove 117 and two bumps 1122 on the blocking portion 112, wherein there is a groove 1124 between the two bumps 1122.

The lever arm 12 has a curved surface 120 and a surface 121, and the curved surface 120 provides a grip for a user to operate the tool. There is a first connecting portion 122 at one end of the lever arm 12, and the first connecting portion 122 has a recess 124 thereon for accommodating and connecting the floating link 14. The recesses 124 has a perforation 124*a* on the two side walls 126, respectively and the first connecting portion 122 also has a perforation 122*a*. The two ends of the floating link 14 have a perforation 14*a* and a perforation 14*b*, respectively, to insert the floating link 14 into the recess 124 so that the perforation 14*a* and the two perforations 124*a* are aligned with each other, wherein a pivotal latch (not shown) is inserted inside the through 14*a* and the two perforations 124*a*. The floating link 14 is pivotally connected to the first connecting portion 122 of the lever arm 12. Furthermore, the perforation 14*b* at the other end of the floating link 14 is pivotally connected to the plunger 16 which has a second connecting portion 162 and a screw hole 164, respectively, wherein the second connecting portion 162 has a recess 166 which has a perforation 168*a* on the two side walls 168, respectively to insert the floating link 14 into the recess 166. The plunger 16 is inserted into the perforation 104 of the base 10 via the recess 102 while the first connecting portion 122 of the lever arm 12 and the floating link 14 are simultaneously inserted into the recess 102 so that the perforation 122*a* of the first connecting portion 122 are aligned with the two perforations 102*a* on the side walls 114 with a pivotal latch 118 (not shown) inserted inside the through 14*a* and the two perforations 124*a*. The first connecting portion 122 of the lever arm 12 is pivotally connected to the side walls 114 of the base 10.

The two ends of the chuck 20 have a recess 202 and a first stud 204, respectively, and there is a blocking portion 206 between the recess 202 and the first stud 204 while the two ends of the displaceable element 18 have a screw hole 182 and a second stud 184, respectively, and there is a gripping portion 186 between the screw hole 182 and the second stud 184 for easy grip for a user to operate. The shape of the gripping portion 186 is hexagonal, quadrangular or polygonal with a rough surface, but it is not limited to. The first stud 204 is then disposed within the screw hole 182 so that the chuck 20 is interconnected with the replaceable element 18, and the second stud 184 of the replaceable element 18 is disposed within the screw hole 164 of the plunger 16 from the other end of the perforation so that the plunger 16, the replaceable element 18 and the chuck 20 are interconnected to each other.

The rod 26 has a first connecting end 262 and a second connecting end 264 with a blocking portion 266 between the first connecting end 262 and the second connecting end 264. The mold base 28 has a recess 282, a recess 284, a recess 285 and an engaging portion 286, wherein the recess 284 is below the recess 282 while the recess 285 is located on the side wall of the mold base 28. A perforation 286*a* is formed inside the engaging portion 286 and the recess 284. The connecting block 22 has a perforation 22*a* and two side walls 222, and a recess 224 is formed between the two side walls 222.

The mold 24 is constituted by an upper mold hinge 242 and a lower mold hinge 244. A stepping portion 245 is provided on the inner surface of the upper mold hinge 242 and the lower mold hinge 244. One end of the upper mold hinge 242 has a third connecting portion 246, and the third connecting portion 246 has two bumps 2462. The two bumps 2462 have a corresponding perforations 2462*a* thereon, respectively and there is a magazine 2464 between two bumps 2462, and one end of the lower mold hinge 244 has a fourth connecting portion 248 having a perforation 248*a* and a fifth connecting portion 250 located below the lower mold hinge 244 and having a perforation 250*a*, wherein the fourth connection portion 248 of the lower mold hinge 244 is disposed in the magazine 2464 of the upper mold hinge 242 such that perforation 248*a* of the fourth connecting portion 248 and the perforations 2462*a* of the two bumps 2462 are aligned with each other with the pivot latch (not shown) inserted inside the perforation 248*a* and the two perforations 2462*a*. One end of the upper mold portion 242 is pivotally connected to one end of the lower mold portion 244 so that the mold 24 can be opened or closed. When the mold 24 is closed, one arc face of the upper mold hinge 242 is adapted to face the arc face of the lower mold portion 244 so as to form a conical perforation 252 for passing through the coaxial cable connector.

The second connecting end 264 of the rod 26 is inserted into the perforation 248*a* of the mold 24 so that the fifth connecting portion 250 of the mold 24 abuts against the blocking portion 266. Further, the second connecting end 264 is inserted into a perforation 30*a* of the springs 30 and a perforation 32*a* of the spring 32. The diameter of the perforation 32*a* is greater than outer diameter of the spring 30, and the wire diameter and the elastic force of the spring 32 are greater than the spring 30. However, the spring 32 and the spring 30 are both elastic members whose elasticity is related to the wire diameter of the spring, for example, the wire diameter of the spring 30 is between 0.1 mm (mm) and 0.3 mm, between 0.15 mm and 0.5 mm, or between 0.3 mm and 1.5 mm, and the wire diameter of the spring 32 is between 0.5 mm (mm) and 1.5 mm, between 0.8 mm and 2 mm, or between 1 mm and 2.5 mm, so that the spring 32 can be disposed in the second connection end 264 and the spring 30 at the same time, wherein one end of the spring 30 can abut against the fifth connecting portion 250 of the mold 24. The second connecting end 264 of the rod 26 is then disposed inside the perforation 286*a* of the mold base 28. The recess 284 can accommodate the spring 32 and the spring 30 with the other end of the spring 30 abutting against the inner wall of the recess 284. The first connecting end 262 of the rod 26 is inserted into the perforation 22*a* of the connecting block 22 via the recess 224.

The connecting block 22, the mold 24, the spring 30, the spring 32 and the mold base 28, which are connected via the rod 26, are then disposed in the recess 106, recess 108 and recess 110 of the base 10, wherein the engaging portion 286 of the mold base 28 is disposed in the recess 110, and the second connecting end 264 of the rod 26 is engaged in the recess groove 117 of the blocking portion 112. The recess 282 of the mold base 28 corresponds to the groove 1124 of the blocking portion 112, the connection block 22, and the fifth connecting portion 250 of the mold 24 are disposed in the recess 108, and the first connecting end 262 of the rod 26 is disposed within the recess 106 through the perforation 22*a* of the connection block 22. The fifth connecting portion 250 of the mold 24 is also located in the recess 224 of the connecting block 22 with the fifth connecting portion 250 abutting against the blocking portion 266 by the elastic force of the spring 30, which in turn controls the movement of the mold 24 through the spring 30. The two ends of the fixing ring 34 are pivotally connected to the recess 285 of the mold base 28, and the fixing ring 34 is rotatable relative to the base 10.

The material of the base 10, the lever arm 12, the floating link 14, the plunger 16, the replaceable element 18, the chuck 20, the connecting block 22, the mold 24, the rod 26, the mold base 28, the spring 32, the fixing ring 34 and the chuck 36 mentioned above is, for example, copper, iron, silver, nickel, tin, gold, copper alloy, copper-tin alloy, copper-nickel alloy, brass, brass, phosphor bronze, beryllium copper, aluminum, aluminum alloy, zinc alloy, steel alloy or one of other high strength plastic polymers, or a combination thereof. In addition, the top chuck 36 and the chuck 20 can be respectively used for different formats of coaxial cable connector, such as F-type coaxial cable connector, BNC type coaxial cable connector, RCA coaxial cable connector, XLR coaxial cable connector, DFP coaxial cable Connector, a DVI type coaxial cable connector, a SCART type coaxial cable connector, or an RF type coaxial cable connector, etc. The user can replace the chuck 36 with the chuck 20 as desired, wherein the formats of the chuck 36 and the chuck 20 are different in appearance, outer diameter or length. Furthermore, the other two receptacles 116 disposed on the base 10 may be provided with different formats of replaceable elements 18 or additional formats of chucks. For example, the replaceable element 18 can have a different external appearance, a different outer diameter, or a different length. Thus, for the purpose of the present invention, the chuck 20 and the replaceable element 18 are a replaceable pressing element module which is changeable for matching with different shapes of the connector.

As shown in FIGS. 6*a*, 6*b*, 7*a* and 7*b*, a coaxial cable 40 is mounted to a connector 38. The coaxial cable connector 38, the coaxial cable 40, the plunger 16 and the replaceable element 18 are coaxially arranged, wherein the chuck 20 is located between the plunger 16 and the coaxial cable connector 38. The connector 38 comprises an inner sleeve 382, an outer sleeve 384 and a nut 386, wherein the outer sleeve 384 is coaxially disposed outside the inner sleeve 382, the nut 386 is radially fitted to the inner sleeve 382, the rear-extension portion of the inner sleeve 382 and the rear-extension portion of the outer sleeve 384 have a gap 387 therebetween, wherein the rear-extension portion of the sleeve 384 has a diameter d1.

When the coaxial cable 40 is mounted to the connector 38, a braided layer 7 and a plastic jacket 9 of the coaxial cable 40 are squeezed into the gap 387 between the rear-extension portion of the inner sleeve 382 and the rear-extension portion of the outer sleeve 384. At this time, a portion of the braided layer 7 will be turned inside out to cover the outer surface of the plastic jacket 9. A metal wire 1, an insulating layer 3 and a thin metal layer 5 of the coaxial cables 40 are inserted into the front end of the inner sleeve 382 from the rear end of the inner sleeve 382, with the metal wire 1 extends into the space formed by the nut 386. The upper mold hinge 242 of the mold 24 is opened from the lower mold hinge 244, and the coaxial cable 40 mounted to the connector 38 is disposed on the groove 1124 of the blocking portion 112, the recess 284 of the mold base 28 and the lower mold hinge 244 of the mold 24, wherein the nut 386 of the coaxial cable connector 38 is radially fitted to the chuck 20. At this time, the metal wire 1 of the coaxial cable 40 can be disposed inside in the recess 202 of the chuck 20. The inner sleeve 382 located inside the nut 386 can abut against the surface of the chuck 20, and then close the upper mold hinge so that the upper mold hinge 242 and the lower mold hinge 244 surround the coaxial cable 40; that is, the coaxial cable 40 is located in the conical perforation 252 of the mold 24. The lever arm 12 is pressed in a direction towards the base 10 while the floating link 14, the plunger 16, the displaceable element 18 and the chuck 20 are pushed by the first connecting portion 122 of the lever arm 12 to move toward the blocking portion 112 of the base 10, wherein the chuck 20 pushes the connector 38 and the coaxial cable connector 38 to move toward the blocking portion 112 of the base 10, that is, moving toward an axial direction of the coaxial cable connector 38, wherein the chuck 20 pushes the coaxial cable connector 38 to abut against the inner wall of the conical perforation 252 of the mold 24 during the movement. When a user applies a force, the mold 24 will move in the direction of towards the blocking portion 112, and the upper mold hinge 424 and the lower mold hinge 422 will also progressively abut against the inner wall of the recess 282 of the mold holder 28, wherein the outer flange of an outer sleeve of the coaxial cable connector 38 will abut against the upper mold hinge 242 and the stepping portion 245 of the lower mold hinge 244. At this time, the spring 30 located in the recess 108 is pressed by the movement of the mold 24. When the user's hand holds the curved surface 121 of the lever arm 12 and presses against the base 10 to force the surface 121 of the lever arm 12 to contact the surface of the base 10, with the lever arm 12 being in parallel with the base 10, the mold 24 is pressed so as to be tightly abutted against the recess 282 of the mold base 28. At this time, the mold 24 presses the spring 32 as well as the spring 30 while the connector 38 is squeezed by the chuck 20, thereby causing the rear-extension portion of the sleeve 384 of the connector 38 to be radially pressed by the mold 24 so as to be deformed into a conic shape. The upper mold hinge 242 and the stepping portion 245 of the lower mold hinge 244 can prevent the connector 38 from being stuck in the mold 24 and being removed uneasily when the user applies an excessive force, in which the diameter d1 of the rear-extension portion 38 of the outer sleeve 384 adjacent to the coaxial cable 40 is reduced to a diameter d2, and the diameter d1 of the rear-extension 38 of the outer sleeve 384 adjacent to the nut 386 remains unchanged. The gap 387 between the rear-extension portion of the inner sleeve 382 and the rear-extension portion of the outer sleeve 384 becomes small. The rear rear-extension of the sleeve 384 is deformed while the braided layer 7 and the plastic jacket 9 of the coaxial cable 40 are pressed so as to allow the coaxial cable 40 be tightly engaged with the coaxial cable connector 38 to avoid falling off easily. After that, the user stops applying force to the lever arm 12 and releases the lever arm 12 while the elastic force of the spring 30 and the spring 32 move the mold 24 towards the lever arm 12 so as to detach the mold 24 from the recess 282 of the mold base 28. The mold 24 pushes the connector 38, the chuck 20, the replaceable element 18 and the plunger 16 to move towards the lever arm 12 until the fifth connecting portion 250 of the mold 24 abuts against the blocking portion 266 of the rod 26. At this time, the lever arm 12 is not restored to the state before it is pressed. The upper mold hinge 242 of the mold 24 is then opened from the lower mold hinge 244, and the connector 38 and the coaxial cable 40 are taken out. The reason to dispose the spring 32 in the recess 106 of the base 10 is that the elastic force of the spring 32 is greater than that of the spring 30, by doing so, the mold 24 can be prevented from being stuck in the recess 282 of the mold holder 28 when the user applies an excessive force.

Furthermore, the fixing ring 34 of the tool of the present invention is designed to greatly reduce the size thereof so that the user can easily carry it. As shown in FIG. 1*b*, when the fixing ring 34 presses the lever arm 12 downwardly to allow the lever arm 12 to contact the surface 121, the fixing ring 34 is rotated to be on the curved surface 121 of the lever arm 12 so as to fix the lever arm 12 to reduce the size of the tool. In addition, the design of the plurality of receptacles 116 on the base 10 also allows the user to use different formats of the replaceable element 18 and the chuck 20, the formats can be different in appearance, outer diameter or length. This tool is capable of being operated to connect connectors with different specifications or formats.

Second Embodiment

FIGS. 8*a* to 8*d* shows a tool in a second embodiment in accordance with the present invention, the tool of the second embodiment differs from that of the first embodiment in that the mold 42 of the tool of the second embodiment replaces the mold 24 and the mold holder 28 of the first embodiment, the securing pin 444 of the second embodiment replaces the fixing ring 34 of the first embodiment, and the replaceable element 46 and the chuck 48 of the second embodiment replace the replaceable element 18 and the chuck 20 of the first embodiment, respectively. For elements of the second embodiment having the same reference numerals as the first embodiment, the above description of the first embodiment can be used for describing said elements in the second embodiment. The coaxial cable tool of the second embodiment includes a base 10, a lever arm 12, a floating link 14, and a plunger 16, a replaceable element 46, a chuck 48, a mold 42, a chuck 36 and a spring 50.

Each element of the present embodiment will be described below. As described above, the base 10 includes a recess 102, a perforation 104, a recess 110, and a blocking portion 112, wherein the recess 102 communicates with the perforation 104, the recess 110 has a perforation 110*a* inside and a perforation 102*a* and the two side walls 114 of the recess 102 have a perforation 104*a* thereon, respectively. The blocking portion 112 has two bumps 1122 thereon, and the bumps 1122 have a groove 1124 therebetween.

The first connecting portion 122 of the lever arm 12 also has a recess 124 for accommodating and connecting the floating link 14, and the two side walls 126 of the recess 124 respectively have a perforation 124*a* thereon. The first connecting portion also has a perforation 122*a* and a perforation 126*a* so as to place the floating link 14 into the recess 124, so that the perforation 14*a* and the two perforations 124*a* are aligned with each other with a pivotal latch is inserted between the perforation 14*a* and the two perforations 124*a*. The floating link 14 is pivotally connected to the first connecting portion 122 of the lever arm 12, and the perforation 14*b* at the other end of the floating link 14 is pivotally connected to the second connecting portion 162 of the plunger 16. The floating link 14 is inserted into the recess 166 so that the perforation 14*b* and the two perforations 168*a* are aligned with each other and a pivotal latch (not shown) being inserted into the perforation 14*b* and the two perforations 168*a*. The floating link 14 is pivotally connected to the second connecting portion 162. The spring 50 is then radially fitted on the screw hole 164 of the plunger 16 and the spring 50 abuts against the second connecting portion 162. The plunger 16 and the recess 102 are inserted into the perforation 104 of the base 10 with the first connecting portion 122 and the floating link 14 of the lever arm 12 disposed into the recess 102 at the same time, so that the first connecting portion 122 and the perforation 122*a* are aligned with the two perforations 102*a* on the side wall 114 with a pivotal latch inserted between the perforation 122*a* and the two perforations 102*a*. The first connecting portion 122 of the lever arm 12 is pivotally connected to the two side walls 114 of the base 10 while at the same time the spring 50 located on the plunger 16 is positioned between the second connecting portion 162 and the wall having the perforation 104, Wherein the spring 50 can abut against the wall having the perforation 104 so that the spring 50 will not slide outside of the perforation 104 when the plunger 16 passes through the perforation 104, wherein the lever arm 12, the floating link 14 and the plunger 16 exhibit an interlocking relationship in the recess 102.

The two ends of the chuck 48 have a recess 482, a blocking portion 484, and a rod 486, respectively, and the blocking portion 206 is located between the recess 482 and the rod 486. The external shape of the blocking portion 484 is hexagonal, quadrangular or polygonal with a rough surface for easy grip by a user. Additionally, a replaceable element 46 is radially fitted on the rod 486, and the replaceable element 46 can be a nut. The rod portion 48 then passes through the perforation 104 so as to be disposed in the screw hole 164 of the plunger 16 to interconnect the chuck 48, the replaceable element 46 and the plunger 16.

The mold 42 comprises an upper mold hinge 424, a lower mold hinge 422, a rod 426, a spring 428, and a latch pin 430. One end of the upper mold hinge 424 has a seventh connecting portion 4242, and the seventh connecting portion 4242 has a perforation (not shown). The other end of the upper mold hinge 424 has a groove (not shown) formed by two side walls 4244, wherein a side wall 4244 has a perforation 4246 thereon, and another side 4244 wall has a recess 4248 thereon. Furthermore, the upper mold hinge 424 has a recess 4249 between the side wall 4246 and the seventh connecting portion 4242. One end of the lower mold hinge 422 has a sixth connecting portion 4222 which has a perforation (not shown) therein, and the other end of the lower mold hinge 422 has a recess 4227 formed by the two side walls 4224, and a side wall 4224 has a perforation 4226 thereon. The latch 430 passes through the perforation 4226 so as to be disposed within the groove 4227. Furthermore, the lower surface of the lower mold hinge 422 has a protruding portion 4229 disposed in the perforation 110*a* of the base 10. The lower mold hinge 422 is locked and fixed to the recess 110 through a fixing screw 119 passing through the perforation 110*a* from the bottom of the base 10. Additionally, a recess 4228 is formed between the side wall 4224 and the sixth connecting portion 4222 of the lower mold hinge 422. The inner wall of the groove 4249 of the upper mold hinge 424 and the inner wall of the groove 4228 of the lower mold hinge 422 are provided with a corresponding stepping portion 4223. One end of the rod 426 includes a clamping hook 4264 and the other end of the rod 426 has a rough surface or a surface having a plurality of notches. Further, a perforation 4262 on the rod 426 is located between the clamping hook 4264 and the end with the rough surface.

The seventh connecting portion 4242 of the upper mold hinge 424 is pivotally connected to the sixth connecting portion 4222 of the lower mold portion 422, and then a pivotal latch (not shown) is inserted through the perforation 4246 of the upper mold hinge 424 and the perforation 4262 of the rod 426. The rod 426 is pivotally connected to the upper mold hinge 424. One end of the spring 428 is disposed in the recess 4248 of the upper mold hinge 424 with the other end of the spring 428 abutting against the surface of the rod. The clamping hook 4264 of the rod 426 is pressed toward the seventh connection portion 4242 of the upper mold hinge 424 by using the elastic force of the spring 428 while the pivotal latch being used as a pivot is inserted through the perforation 4262 of the rod 426. When the upper mold hinge 424 and the lower mold hinge 422 are closed, the recess 4249 of the upper mold hinge 424 and the recess 4228 of the lower mold hinge 422 form a tapered perforation 421 having an inner wall 4220 and a conical inner wall 4221 connected to the inner wall 4220 and connected to the stepping portion 4223 opposite the inner wall 4220, whereby an opening of the inner wall 4220 is smaller than an opening of the conical inner wall 4221, and the clamping hook 4264 is hooked on the latch 430 of the groove 4227 so that the upper mold hinge 424 and the lower mold hinge 422 can be fixedly engaged with each other. When the upper mold hinge 424 is open from the lower mold portion 422, the user applies the finger to the rough surface of the rod 426 so that the clamping hook 4264 of the rod 426 moves in a direction away from the groove 4227 while the clamping hook 4264 is released from the latch 430. The groove formed by the two side walls 4244 of the upper mold hinge 424 moves upwardly toward the lower mold hinge 422 so that the upper mold hinge 424 is opened from the lower mold hinge 422.

Additionally, when the one end of the lever arm 12 moves toward the base 10, the other end of the lever arm 12 takes the pivotal latch 118 in the perforation 122*a* and the two perforation 102*a* as a pivot so as to make the lever arm 12 rotatable relative to the base 10. When rotating, the first connecting portion 122 of the lever arm 12 simultaneously drives the floating link 14, the plunger 16, the replaceable element 46 and the chuck 48 to move towards the mold 42 while the plunger 16 radially fitted on the spring 50 abutting against the second connecting portion 162 until the spring 50 abuts against the side wall of the perforation 104. As the lever arm 12 being pressed continues to move towards the base 10, the spring 50 will be pressed by the second connecting portion 162 to reduce its length until the inner surface of the lever arm 12 abuts against the surface of the base 10. The perforation 126*a* on the first connecting portion 122 of the lever arm 12 will be aligned with the perforation 104*a* of the base 10. The user can insert the securing pin 444 into the perforation 104*a* and the perforation 126*a* with one end of the securing pin 444 locked with a nut 442 so as to fix the securing pin 444 on the base 10, thereby causing the lever arm 12 fixed to the base 10 horizontally, making it convenient for the user to store the tool.

When a user wants to use the tool, the nut 442 is unlocked and the securing pin 444 is removed. At this time, since the securing pin 444 on the first connecting portion 122 disappears, the spring 50 will not be pressed by the second connecting portion 162 and return to its original shape by the elastic force of the spring 50, which will push the second connecting portion 162 of the plunger 16 and in turn moves the linking floating link 14 and the first connecting portion 122 with one end of the lever arm 12 moving in a direction away from the base 10.

The material of the replaceable element 46, the chuck 48, the mold 42, the spring 50, the spring 428, and the latch 430 can be, for example, copper, iron, silver, nickel, tin, gold, copper alloy, copper-tin alloy, copper-nickel alloy, brass, brass-alloy, phosphor bronze, beryllium copper, aluminum, aluminum-alloy, zinc alloy, steel alloy or one of other high strength plastic polymers, or a combination thereof. In addition, the chuck 48 can be used for different formats of coaxial cable connectors, such as F-type coaxial cable connector, BNC type coaxial cable connector, RCA coaxial cable connector, XLR coaxial cable connector, DFP coaxial cable connector, DVI coaxial Cable connector, SCART type coaxial cable connector or RF type coaxial cable connector, etc. The user can replace the chuck 48 with different formats, and the two receptacles 116 on the base 10 can also be set in different form to accommodate different format of the replaceable element 46 or the chuck 48, for example, a chuck 48 having a different outer diameter, a different outer diameter or a different length, etc. Thus, for the present embodiment, the chuck 48 is a replaceable pressing element module, which is changeable for matching with connectors in different formats.

Figure 9A:
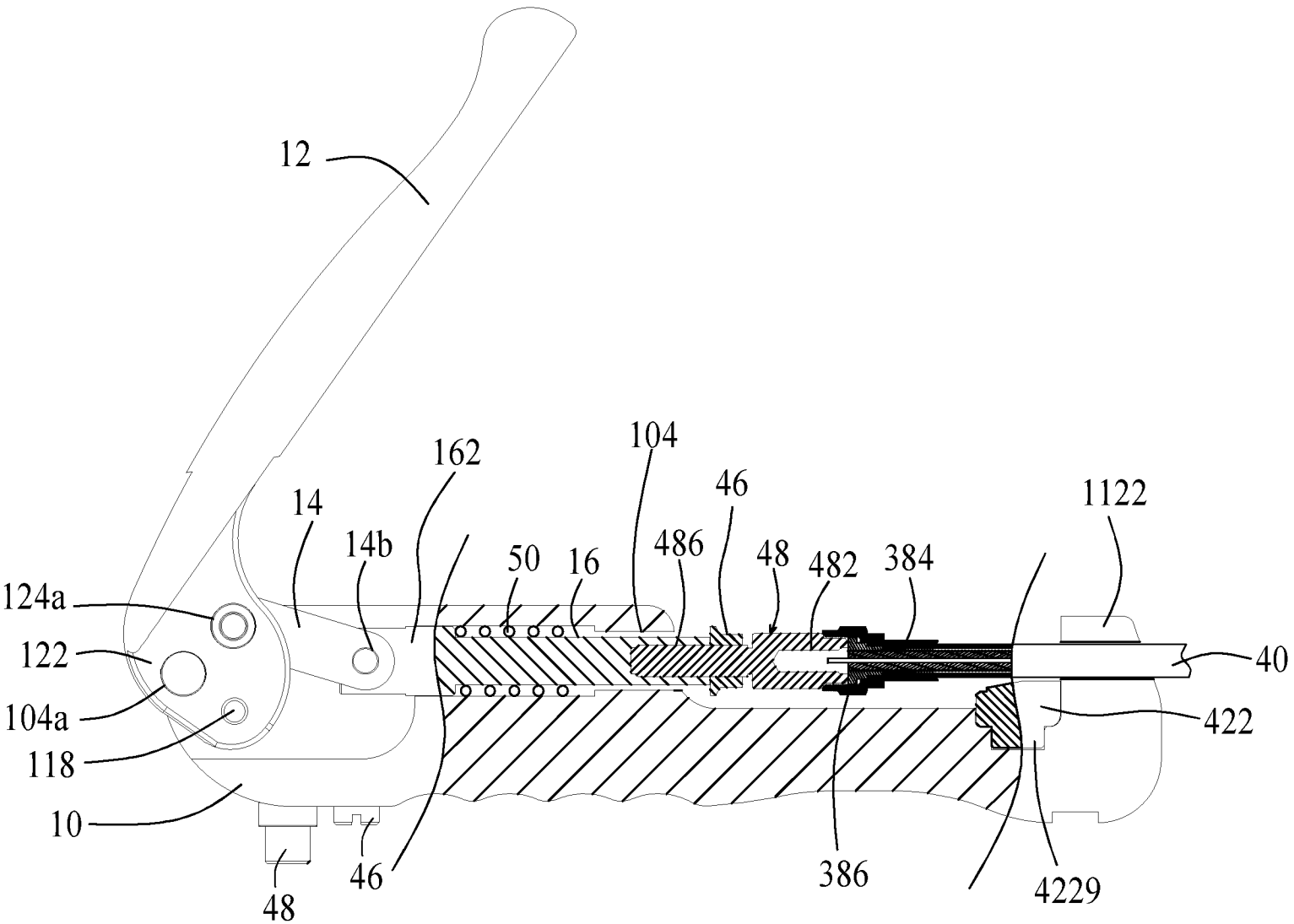
FIG. 9*a* is a schematic cross-sectional view showing the tool of the second embodiment after the coaxial cable connector is operated.
Figure 9B:
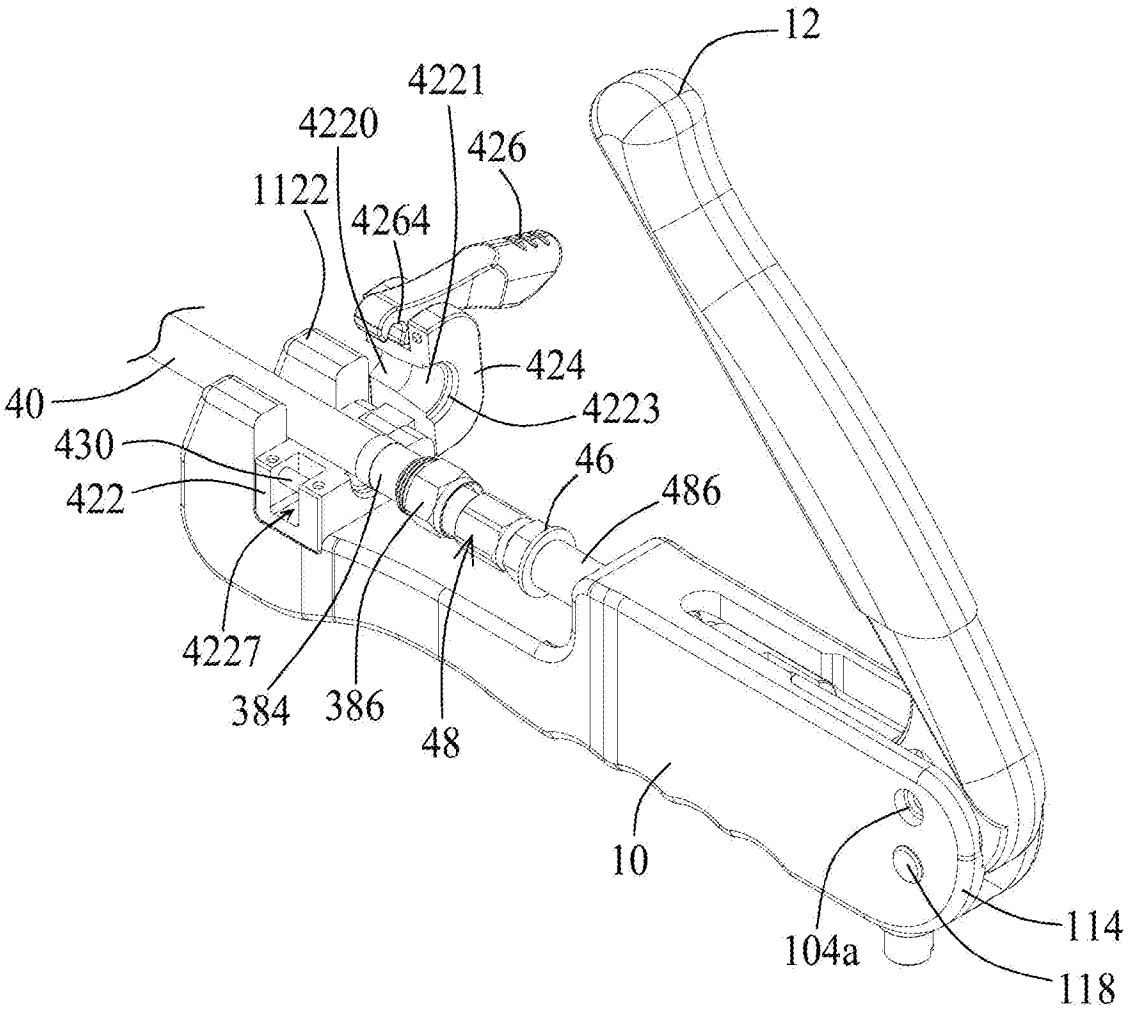
FIG. 9*b* is a schematic 3D view of the tool of the second embodiment when mounting a coaxial cable to a connector.
Figure 9C:
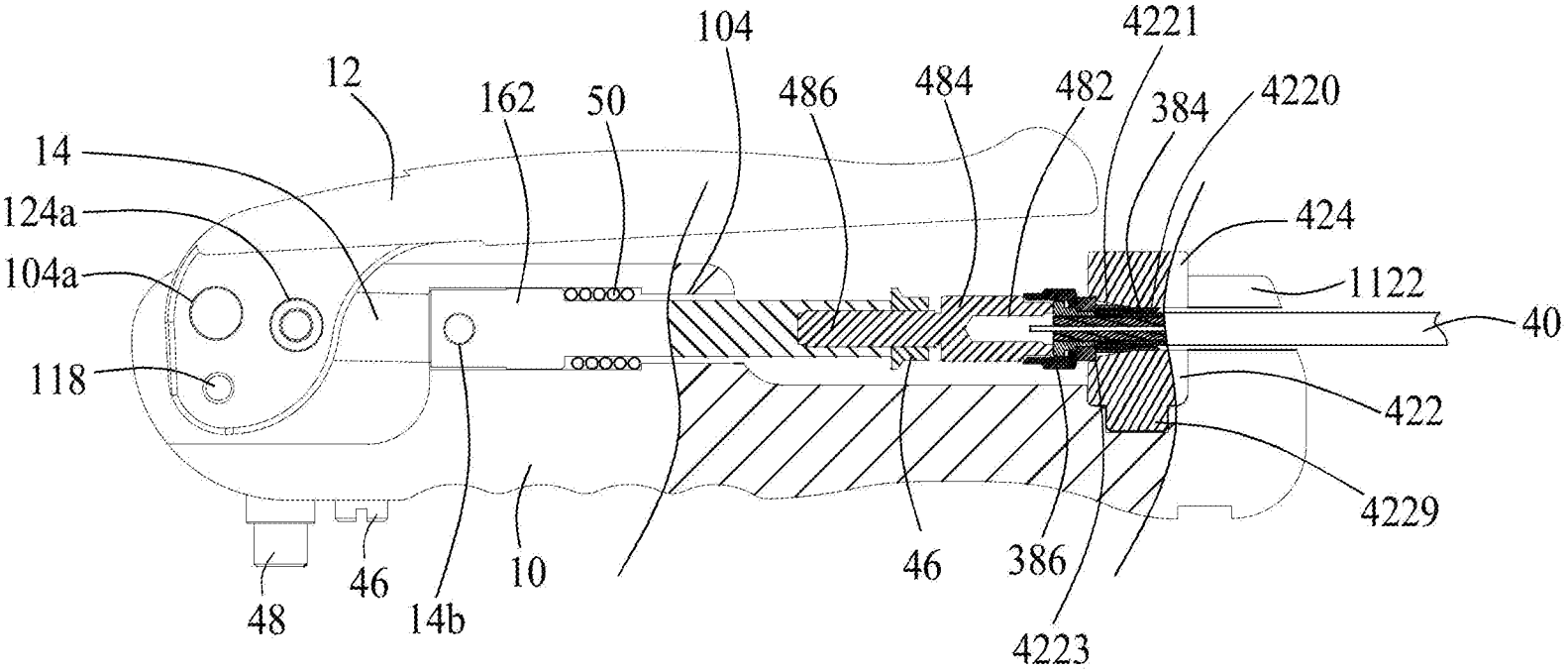
FIG. 9*c* is a schematic cross-sectional view showing the tool of the second embodiment after the coaxial cable connector is operated.

As shown in FIGS. 9*a*, 9*b*, and 9*c*, the coaxial cable 40 is mounted on the connector 38, and the upper mold hinge 424 of the mold 42 is open from the lower mold hinge 422. The coaxial cable 40 mounted on the connector 38 is disposed on the groove 1124 of the blocking portion 112 and the lower mold hinge 422 with the nut 386 of the connector 38 radially fitted on the chuck 48. The metal wire 1 of the coaxial cable 40 can be disposed, within the recess 482 of the chuck 48, and the inner sleeve 382 disposed inside the nut 386 can abut against the surface of the chuck 48, and then, the upper mold, hinge 424 is closed so as to allow the upper mold hinge 424 and the lower mold hinge 422 surround the coaxial cable 40, in which the coaxial cable 40 is located in the tapered perforation 421 of the mold 42 with the clamping hook 4264 being attached to the latch 430 of the lower mold hinge 422 so as to fix the upper mold hinge 422 and the lower mold hinge 422.

The lever arm 12 is pressed towards the base 10 while the first connecting portion 122 of the lever arm 12 pushes the floating link 14, the plunger 16, the spring 50, the replaceable element 46, and the chuck 48 to move toward blocking portion 112 of the base. During movement, the spring 50 abuts against the wall having the perforation 104 so as to be pressed. The chuck 48 also pushes the connector 38 and the coaxial cable 40 to move toward the blocking portion 112 or toward an axial direction of the connector 38, wherein the chuck 48 will push the connector 38 to abut against the inner wall 4220 and a portion of the conical inner wall 4221 of the tapered perforation 421 of the mold 42 during the movement. When the surface of the lever arm 12 is in contact with the surface of the base 10, the lever arm 12 will be in parallel with the base 10.

The rear-extension portion of the outer sleeve 384 of the connector 38 disposed in the tapered perforation 421 is radially pressed by the mold 42 so as to be deformed into a cylindrical and a conic shape as the connector 38 is squeezed by the chuck 48. At this time, the outer flange of the outer sleeve 384 of the connector 38 abuts against the stepping portion 4223 of the mold 42. The stepping portion 4223 can block the connector 38 from being stuck in the mold 42 and being removed uneasily when the user applies the force overmuch, wherein the diameter d1 of the rear-extension portion 38 of the outer sleeve 384 adjacent to the coaxial cable 40 is reduced by the inner wall 4220 to a diameter d2, and the diameter d1 of the rear-extension 38 of the outer sleeve 384 adjacent to the nut 386 remains unchanged by the other portion of the conical inner wall 4221. The gap 387 between the rear-extension portion of the inner sleeve 382 and the rear-extension portion of the outer sleeve 384 becomes small. The rear rear-extension of the sleeve 384 is deformed while the braided layer 7 and the plastic jacket 9 of the coaxial cable 40 are pressed so that the coaxial cable 40 is tightly engaged with the coaxial cable connector 38 to avoid falling off easily. The user then stops forcing the lever arm 12 and release the lever arm 12. At this time, the elastic force of the spring 50 pushes the second connecting portion 162 of the plunger 16 and also causes the linking floating link 14 and the first connecting portion 122 to move. One end of the lever arm 12 moves toward a direction away from the base 10. Ultimately, the lever arm 12 is resorted to the state before it is pressed.

After that, the fingers of a user applies a force on the rough surface of the rod 426 to move the clamping hook 4264 of the rod 426 in a direction away from the groove 4227 with the clamping hook 4264 being detached from the latch 430. The groove formed by the two sidewalls 4244 of the upper mold hinge 424 moves upwardly toward the lower mold hinge 422, which in turn open the upper mold hinge 424 from the lower mold hinge 422 to allow the user to take out the connector 38 and coaxial cable 40 being mounted on the connector 38.

Third Embodiment

Figure 10A:
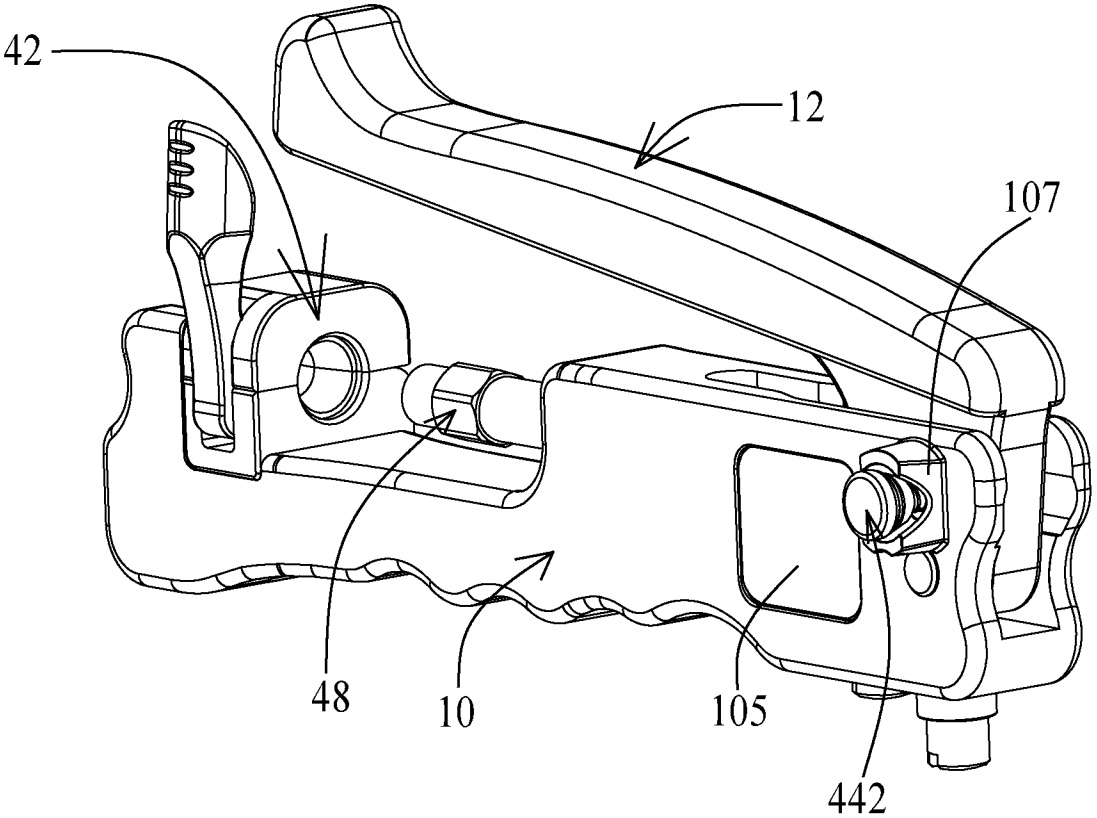
FIGS. 10*a*, 10*b* and 10*c* shows a tool according to a third embodiment of the present invention.

As shown in FIG. 10*a*, the tool of the third embodiment is similar to the first embodiment and the second embodiment, and only the structures and the actions that are different from that of the first and the second embodiments will be described below. The appearance of the tool of the embodiment is somewhat different from that of the first and second embodiments described above, particularly the base 10. In the present embodiment, a region 105 may be disposed on the base 10 for the manufacturer to post the usage information of the tool. Additionally, the base 10 comprises a receiving slot 107 for accommodating the exposed nut 442.

Figure 10B:
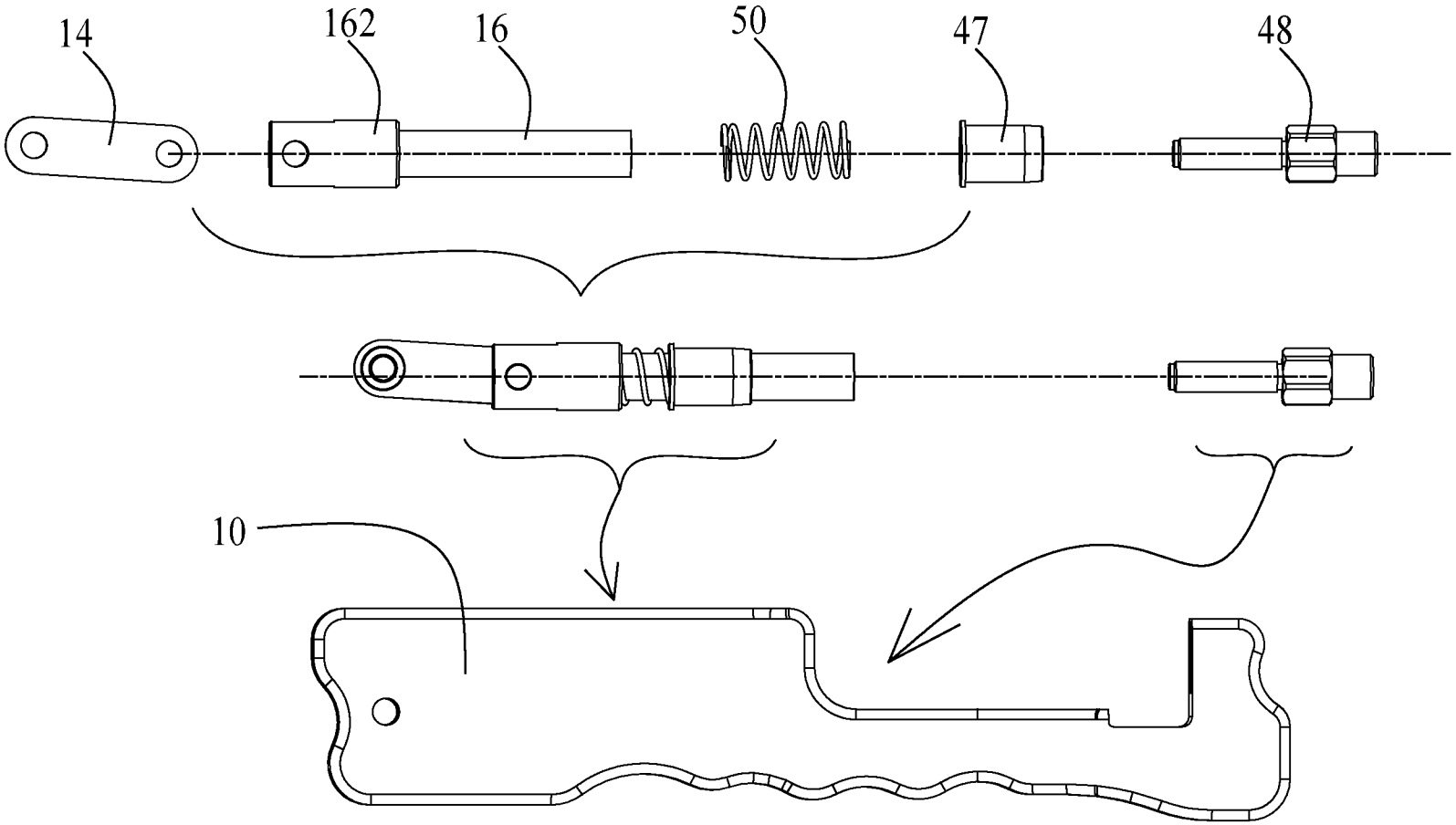
Figure 10C:
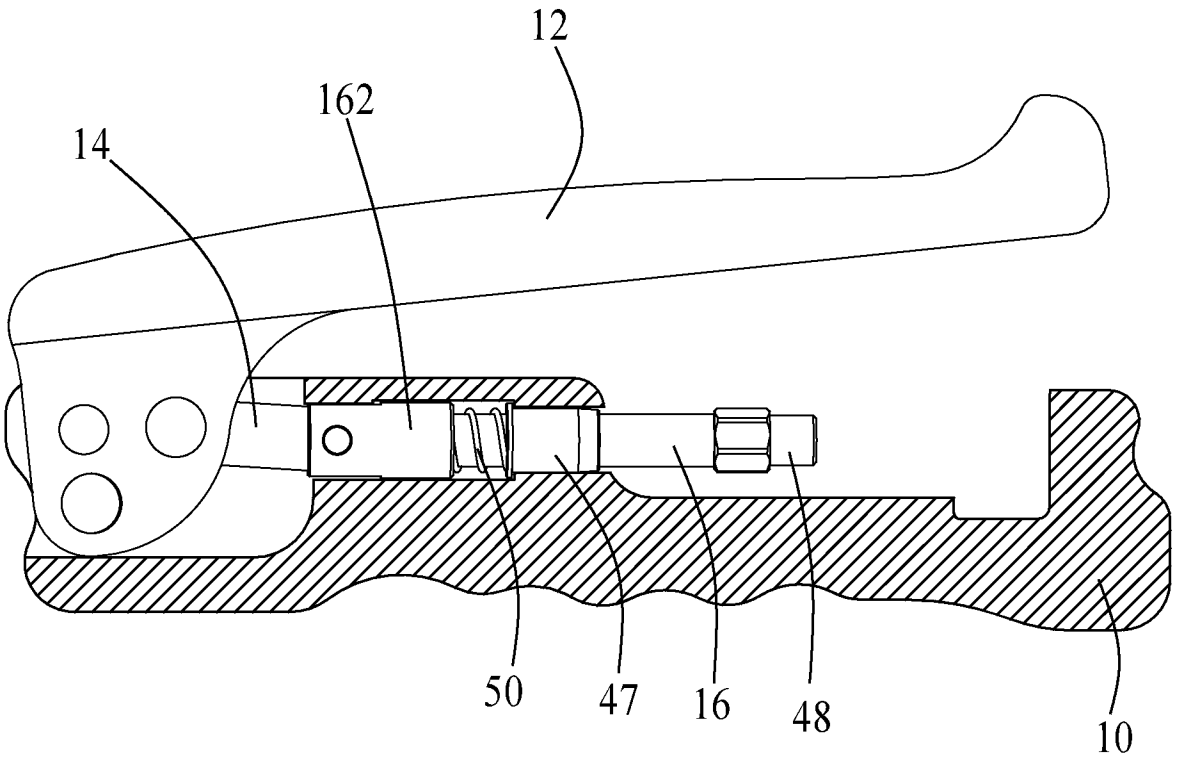

As shown in FIGS. 10*b* and 10*c*, the replaceable element 46 of the second embodiment is replaced with a blocking element 47, and the blocking element 47 is disposed in the recess 102 of the base 10, wherein the floating link 14, the plunger 16, the spring 50 and the blocking element 47 can be assembled in advance, wherein the spring 50 and the blocking element 47 are radially fitted to the plunger 16 while the plunger 16 moves relative to the blocking element 47 in an axial direction. The plunger 16 is disposed in the recess 102 of the base 10 after the assembly is completed. The chuck 48 is then inserted from the perforation 104 of the base 10 so as to be engaged with the plunger 16.

When one end of the lever arm 12 moves toward the base 10, the movement of the other end of the lever arm 12 enables the floating link 14 to push the plunger 16 to move in an axial direction. The spring 50 will be pushed by the second connecting portion 162 of the plunger 16 so as to push the blocking element 47 with the protrusion of one end of the blocking element 47 abutting against the inner wall of the perforation 104 to prevent the blocking element 47 from moving. If the plunger 16 keeps moving towards the mold 42, the spring 50 is pressed to generate an elastic force; if the user stops applying force to the lever arm 12, then the spring 50 pushes the plunger 16 of the second connecting portion 162 in the opposite direction. Other descriptions can be referred to the descriptions in the second embodiment.

Though the embodiment of the present invention have been shown and described, it will be understood by those skilled in the art that such embodiments may be varied without departing from the principles and spirit of the present invention. The scope of the present invention is limited by the scope of the patent application adopted and its equivalents. The scope of protection of the present invention shall be defined as the scope of the patent application as claimed. It should be noted that the wording "include" does not exclude other elements and the word "one" does not exclude multiple.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

What is claimed is:

1. A tool adapted to mount a coaxial cable extending in a first axial direction to and through an outer sleeve of a connector, comprising:

a plunger; and a mold, comprising:

an upper mold hinge, and a lower mold hinge, wherein the upper mold hinge is pivotally connected to the lower mold hinge and configured to rotate with a rotation axis, having a second axial direction parallel to the first axial direction and form a tapered perforation having an inner wall and a conical inner wall connected to the inner wall, and a stepping portion connected to the conical inner wall opposite the inner wall, whereby an opening of the inner wall is smaller than an opening of the conical inner wall, wherein when the upper and lower mold hinges are connected and the plunger pushes the connector thereto, an outer flange of the outer sleeve of the connector abuts the stepping portion, preventing further movement thereto, the outer sleeve is radially deformed at areas abutting the inner wall and a portion of the conical inner wall connected to the inner wall.

2. The tool of claim 1, further comprising a base and a lever arm pivotally connected to the base, wherein the base comprises a perforation therein for the plunger to pass therethrough, and the lever arm rotates relative to the base, forcing the plunger to move along the first axial direction.

3. The tool of claim 2, further comprising a floating link pivotally connected to the plunger and the lever arm.

4. The tool of claim 1, further comprising:

a first chuck configured for a first connector of a first connector type, positioned between the plunger and the coaxial cable along the first axial direction; and a first replaceable element configured for the first connector and a second connector of a second connector type, disposed between the plunger and the first chuck along the first axial direction, wherein when the coaxial cable is assembled to the first connector, the first chuck presses the first connector to the mold in the first axial direction.

5. The tool of claim 4, further comprising:

at least one receptacle disposed within the base; and a second chuck configured for a second connector of a second connector type, stored in the at least one receptacle, interchangeable with the first chuck, wherein when the first chuck is interchanged with the second chuck and the coaxial cable is assembled to the second connector, the second chuck is positioned between the plunger and the coaxial cable and the first replaceable element is disposed between the plunger and the second chuck, both along the first axial direction, whereby the second chuck presses the first connector to the mold in the first axial direction.

6. The tool of claim 1, further comprising a base having a recess disposed near an end thereof and a perforation disposed between the recess and an opposite end thereof, wherein the mold is disposed in the recess and the plunger is moveable in the first axial direction through the perforation.

7. The tool of claim 1, further comprising:

a spring, radially and fittingly disposed surrounding the plunger; and a base having a recess disposed near an end thereof and a perforation disposed between the recess and an opposite end, wherein the mold is disposed in the recess and the plunger is moveable in the first axial direction through the perforation.

8. The tool of claim 1, further comprising a first rod having a clamping hook on one end thereof, pivotally connected to the upper mold hinge, and a latch disposed on the lower mold hinge, wherein the clamping hook is configured to hook on to the latch.

9. The tool of claim 8, further comprising a spring disposed between the upper mold hinge and the first rod, whereby movement of the first rod relative to the upper mold hinge is subject to the spring.

10. The tool of claim 1, further comprising:

a base having a recess disposed near an end thereof, a first perforation disposed between the recess and an opposite end, and a second perforation disposed on sidewalls of the base at the opposite end; and a lever arm pivotally connected to the base and plunger, having a connecting portion comprising a third perforation therethrough, wherein the mold is disposed in the recess and the plunger is moveable in the first axial direction through the perforation, and wherein when the lever arm is rotated parallel to the base, a securing pin is adaptable to be disposed through the third perforation and second perforations, fixing the lever arm in position.

11. The tool of claim 1, further comprising:

a third chuck configured for a third connector of a third connector type and a fourth connector of a fourth connector type, positioned between the plunger and the coaxial cable along the first axial direction;

a second replaceable element configured for the third connector, disposed between the plunger and the first chuck along the first axial direction, wherein when the coaxial cable is assembled to the third connector, the third chuck presses the third connector to the mold in the first axial direction.

12. The tool of claim 11, further comprising:

at least one receptacle disposed within the base; and a third replaceable element configured for the fourth connector, stored in the at least one receptacle, interchangeable with the second replaceable element, wherein when the second replaceable element is interchanged with the third replaceable element and the coaxial cable is assembled to the fourth connector, the third chuck is positioned between the plunger and the coaxial cable and the third replaceable element is disposed between the plunger and the third chuck, both along the first axial direction, whereby the third chuck presses the fourth connector to the mold in the first axial direction.

13. The tool of claim 1, wherein an other portion of the conical inner wall connected to the steeping portion does not abut and deform the first outer sleeve radially, preventing the outer flange abutting against the steeping portion from being wedged to the steeping portion when removed therefrom.

* * * * *